United States Patent [19]

Rodriguez

[11] Patent Number: 4,659,029

[45] Date of Patent: Apr. 21, 1987

[54] APPARATUS AND METHOD FOR CUTTING AND SPOOLING A WEB OF PAPER

[76] Inventor: Peter A. Rodriguez, 1785 Selva Marina Dr., Jacksonville, Fla. 32233

[21] Appl. No.: 800,633

[22] PCT Filed: Jun. 20, 1984

[86] PCT No.: PCT/US84/00941

§ 371 Date: Sep. 29, 1985

§ 102(e) Date: Sep. 29, 1985

[87] PCT Pub. No.: WO86/00282

PCT Pub. Date: Jan. 16, 1986

[51] Int. Cl.[4] ..... B65H 19/26

[52] U.S. Cl. ..... 242/56 R; 242/65; 242/74; 242/76; 83/636; 428/295

[58] Field of Search ..... 242/56 R, 56 A, 56.6, 242/65, 74, 75.2, 76; 83/542, 636, 660, 695; 225/100, 106; 428/294, 295

[56] References Cited

U.S. PATENT DOCUMENTS

| | | | |
|---|---|---|---|
| 2,461,246 | 2/1949 | Weyenberg | 242/56 R |
| 3,126,312 | 3/1964 | Nickerson | 428/295 |
| 3,135,446 | 6/1964 | Sargent | 225/100 |
| 3,497,050 | 2/1970 | Landgraf | 242/74 X |
| 3,552,101 | 1/1971 | Papp | 242/68.1 X |
| 3,599,888 | 8/1971 | Coudriet | 242/74 X |
| 3,765,615 | 10/1973 | Brink | 242/56 R |
| 3,836,095 | 9/1974 | Kruhn | 242/76 X |
| 4,293,100 | 10/1981 | Sharlow | 242/75.2 |
| 4,335,858 | 6/1982 | Cranna | 242/76 X |
| 4,358,979 | 11/1982 | Kurzbuch | 83/660 X |
| 4,414,258 | 11/1983 | Corbin, Sr. | 428/193 |

*Primary Examiner*—John M. Jillions

*Attorney, Agent, or Firm*—Arthur G. Yeager

[57] ABSTRACT

An apparatus 15 and method for cutting a travelling paper web 20 winding on a spool 21 and transferring web 20 onto an empty spool 23 by attaching a cutting tape to empty spool 23, characterized by:

(1) a tape dispenser 16 supplying repulpable paper fiber stiff tape 24;

(2) an elongated guideway 28 having an open end 49 through which tape 24 is fed to the opposite end 50, the ends being adjacent the side edges of web 20;

(3) a cutter 38 to partially cut the tape 24 adjacent end 49; and (4) a friction brake 39 engaging tape 24 between the cutter 38 and end 49 to cause tape 24 to completely sever thereat as the tape is spirally wound about the empty spool.

40 Claims, 14 Drawing Figures

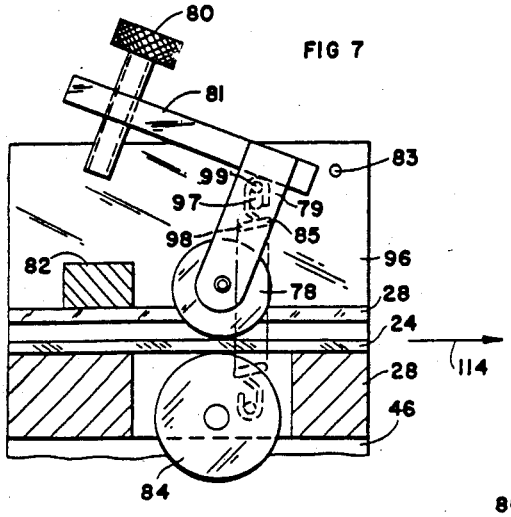
FIG 7
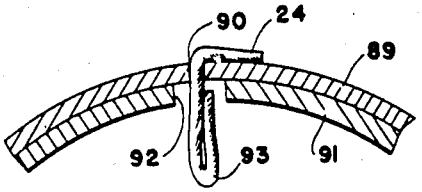
FIG 10
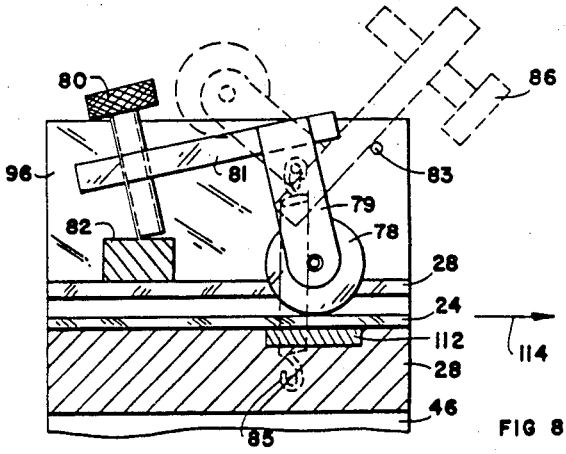
FIG 8
FIG 9
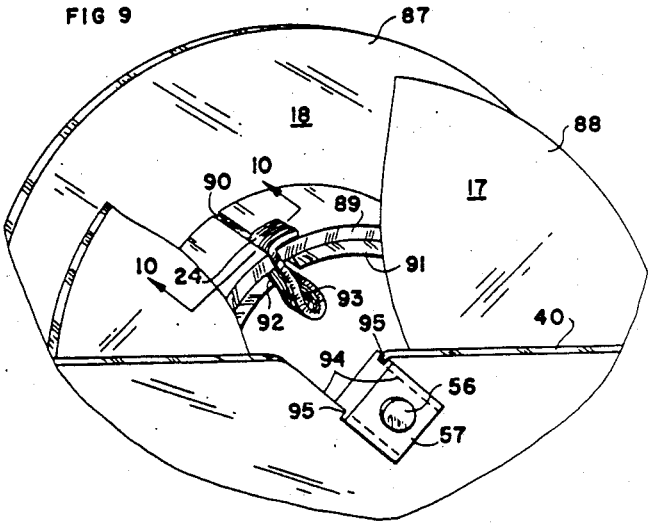

APPARATUS AND METHOD FOR CUTTING AND SPOOLING A WEB OF PAPER

TECHNICAL FIELD

This invention relates to an apparatus and method for cutting a travelling web of paper being wound on one spool and transferring the web to an empty spool while the web is travelling.

BACKGROUD ART

It is a general practice in the paper industry to produce a continuous sheet or web of paper which is wound onto large spools. In order to have a continuous operation it is, of course, necessary to have a system for instantaneously switching from winding the web of paper onto a full roll to an empty roll, particularly at modern speeds of paper production. In U.S. Pat. No. 2,461,246 there is shown a method of feeding a tape onto the rotating empty roll core and causing it to be spirally wrapped on that core as it stretches tight across the travelling web of paper and cuts the paper, with the cut edge being led onto the empty roll supported by the cutting tape. Subsequent improvements have dealt with methods of stringing the tape for cutting and feeding, and the use of various types of tapes, as shown for example in U.S. Pat. No. 3,599,888. A more recent improvement is found in U.S. Pat. No. 4,414,258 where there is described a tape made of repulpable paper woven into a tape which did not interfere with the paper making process since the paper wound adjacent the roll is waste and is recycled.

It is an object of this invention to provide an improved apparatus for cutting a paper web and transferring the cut portion to an empty spool. It is another object to provide such a system employing an improved repulpable paper tape. Still another object is to provide a substantially automatic feeding apparatus for introducing the tape to the empty spool. Other objects will appear from the more detailed description which follows.

BRIEF DESCRIPTION OF THE INVENTION

This invention relates to an apparatus for cutting a travelling web of paper being wound on a first spool and transferring that travelling web onto an empty spool by attaching a cutting tape to the empty spool, the apparatus characterized by:

(1) means for supplying a length of repulpable paper fiber stiff tape;

(2) an elongated guideway with an elongated open slot facing upwardly beneath said travelling web and having opposite open ends adjacent the side edges of said travelling web, the guideway receiving the tape delivered slidingly into one open end and exiting out of the other open end; and (3) a brake means frictionally engaging the tape.

The apparatus also includes a dispenser having a continuous length of cutting tape wound on a rotatable drum and being thin and stiff and being formed of a plurality of lengthwise parallel strands of twisted repulpable paper fibers laid side-by-side and bonded to each other by a water-soluble adhesive and being one strand in thickness. A cutter is provided between the brake means and the drum for cutting laterally across the tape to partially sever the strands. The brake means is located between the guideway and drum and includes an underneath supporting surface and an upper pressure surface adjustable to provide selective frictional resistance to the passage of the tape therebetween. The tape completely severs upon the passage of the partially severed strands between the brake means and the ends of the guideway as the tape is being spirally wound about the empty spool.

This invention also relates to an improved method for cutting a travelling web of paper being wound on a spool and transferring the web after cutting to an empty spool, the method including a cutting tape attachable to the empty spool, the tape automatically being wound spirally about the empty spool and cutting the web of paper, and winding the cut portion of the paper web onto the empty spool; the improvement comprises:

(1) feeding the free end of a stiff paper tape into the near end of an elongated guideway beneath the travelling web and extending beyond both ends of the empty spool;

(2) extending the free end of the tape from the far end of the guideway;

(3) adhering the free end to the edge of the empty spool;

(4) partially cutting laterally through the tape adjacent the near end of the guideway; and (5) applying frictional resistance to the tape between the cut and the guideway to cause the partially cut tape to become completely severed by the pulling of the tape caused by winding thereof on the empty roll.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

FIG. 7 is a cross-sectional view of the brake means taken along line 7, 8—7, 8 of FIG. 4.

FIG. 8 is a cross-sectional view of an alternate embodiment of the brake means, showing the inoperable position in broken lines, and taken along line 7, 8—7, 8 of FIG. 4.

FIG. 9 is a partial isometric view of the tape supply drum of this invention.

FIG. 10 is a partial cross-sectional view taken along line 10—10 of FIG. 9.

DETAILED DESCRIPTION AND BEST MODE OF THE INVENTION

Figure 1:
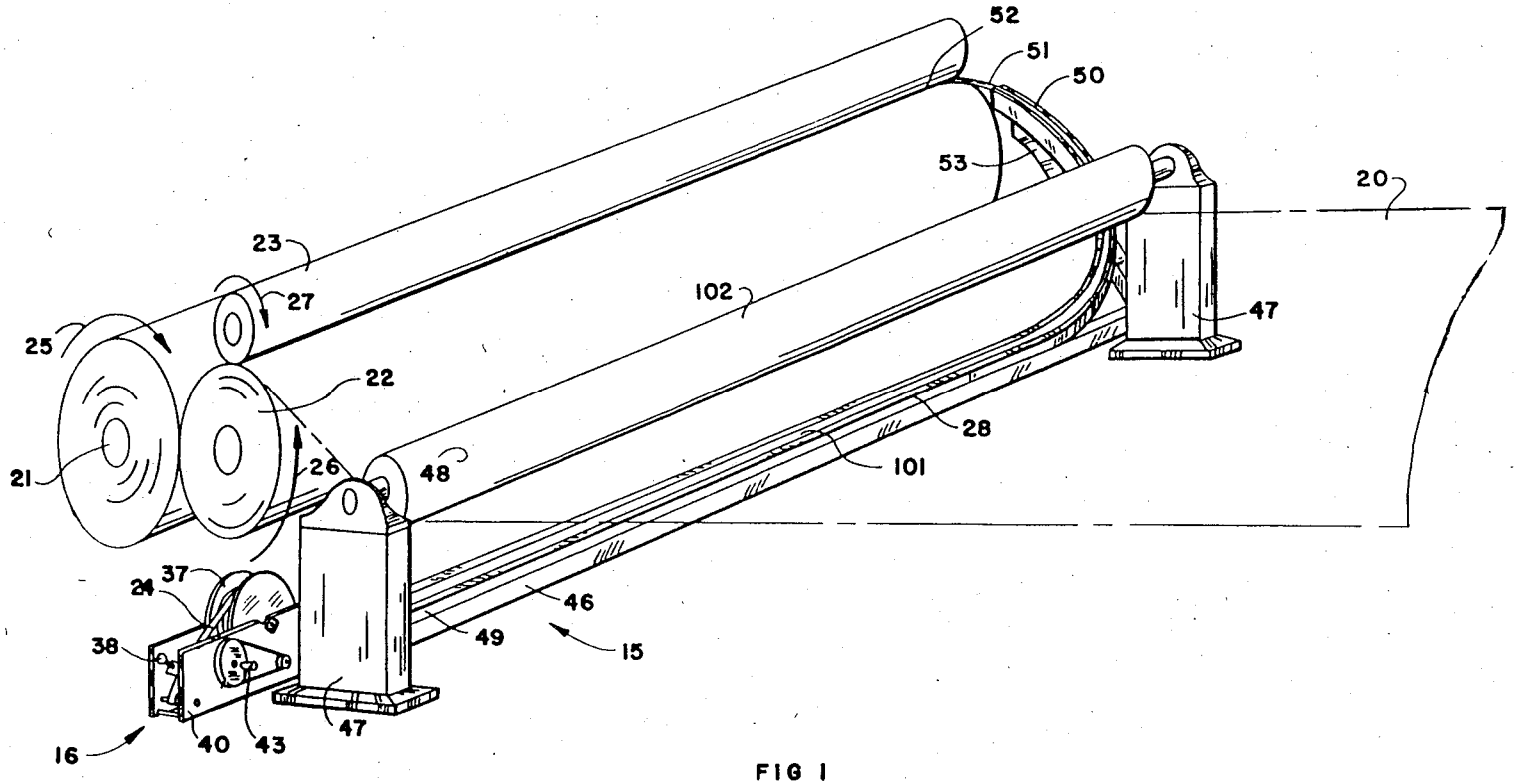
FIG. 1 is a perspective view of the system of rollers employed in the paper industry to wind the paper web onto rolls, and the present apparatus used to cut the web and transfer the cut edge to an empty spool in accord with this invention.

The general features of this invention are best seen and understood by reference to FIG. 1 which shows some of the equipment employed in a paper manufacturing plant to wind up the manufactured paper on rolls for storage and use elsewhere. A continuous web of paper 20 travels at a relatively rapid rate of speed to a combination of spools upon which the paper is rolled. Paper web 20 advances toward tension roll 102, mounted in journals on supports 47, leading web 20 over driving roll 22 and winding about spool 21 turning in the direction of arrow 25. Driving roll 22 turns in the direction of arrow 26 and is pressed against the paper roll on spool 21 causing it to rotate in the indicated direction. When spool 21 has been filled to the desired capacity with paper from web 20, it is necessary to cut web 20 laterally, transfer the cut edge to an empty spool, and start the web winding on that spool to eventually produce another filled spool, such as spool 21. Empty spool 23 is positioned vertically above the location shown in FIG. 1 until it is ready to accept paper from web 20 and begin winding it up. In order to cause empty spool 23 to begin rotating and to accept the cut edge of web 20, it is necessary to lower spool 23 until it contacts driving roll 22, as shown in FIG. 1, and then to introduce the cut edge of web 20 into the nip 52 between empty spool 23 and driving roll 22 and to cause a transfer of the paper web thereto.

The apparatus of this invention is generally indicated by reference numeral 15 which is a means in the form of a dispenser 16 for introducing a tape to the far edge of empty spool 23 and causing that tape to wrap around spool 23 in a spiral fashion, and, in so doing, cut web 20 and cause the cut edge to be introduced onto spool 23 and to transfer the cut web 20 to become wrapped about spool 23. A supply of cutting tape 24 is preferably maintained on a removable drum 37 in a housing 40 which also serves to support a cutting means 38 which, at the appropriate time, cuts tape 24 from the large supply on drum 37. It will be appreciated that only a finite length of tape, longer than the width of web 20, is needed to cut across web 20 laterally and to cause the cut edge to begin wrapping itself upon empty spool 23, and thus at the appropriate place tape 24 is cut and further tape is not needed until spool 23 becomes filled with paper and must be replaced by another empty spool. Tape 24 passes through cutting means 38 and into a guideway 28 propelled by a driving means operated by a hand crank 43 to cause the free end of tape 24 to move completely across the width of web 20 underneath that web in guideway 28 until it reaches the far end 50 where the free end 51 of tape 24 is made available to be inserted into nip 52 between spool 23 and driving roll 22. Preferably, an adhesive is applied to the tape 24 at free end 51 so that when it is introduced into nip 52 it will adhere to the surface of empty spool 23. A frictional resistance is then applied to the tape adjacent near end 49 to cause the tape to spiral across the length of empty spool 23 and cut through web 20 as it does so and causes a transference of the web 20 onto empty roll 23.

Figure 2:
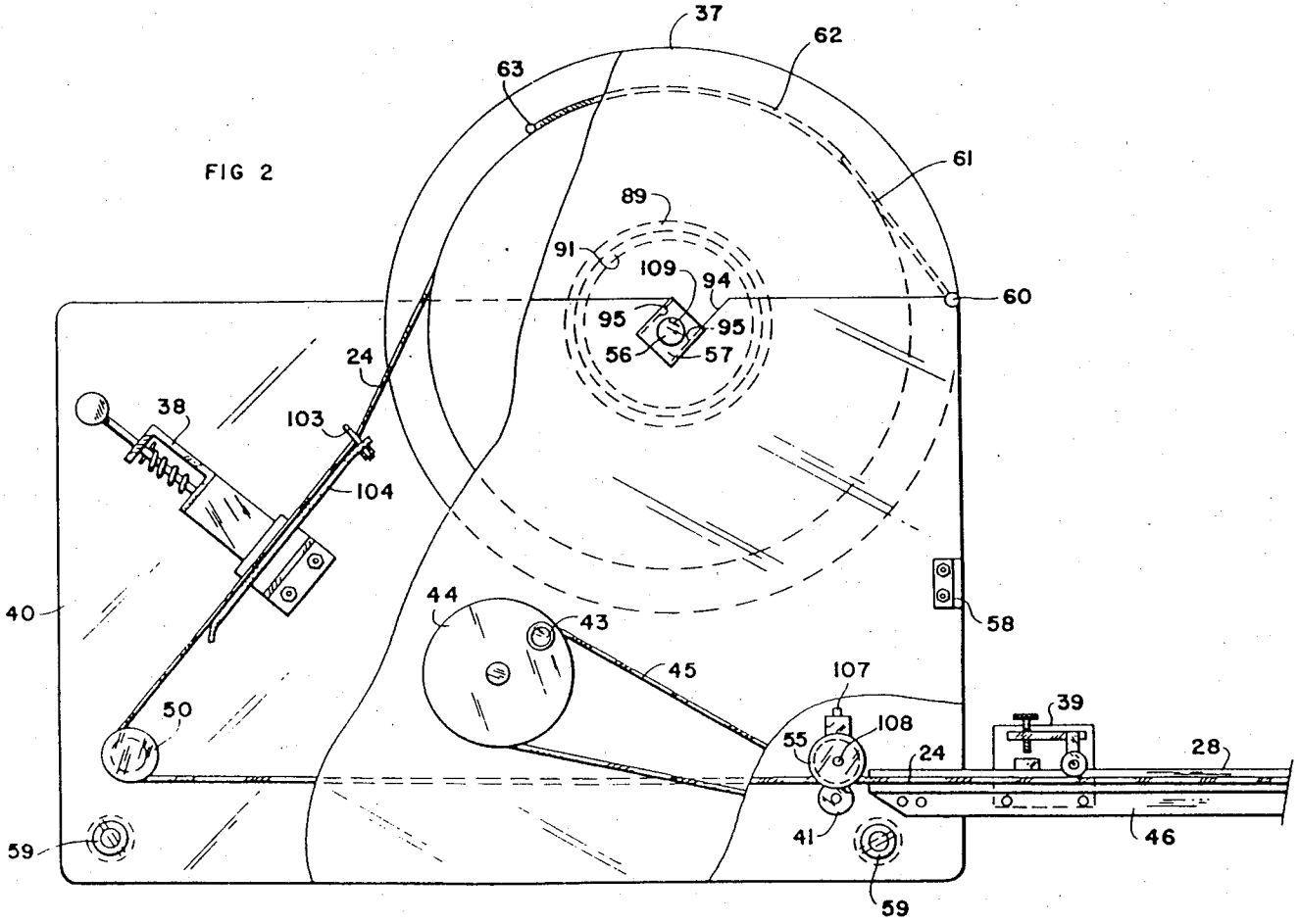
FIG. 2 is an enlarged side elevational view of a portion of the apparatus of FIG. 1 partly cut away for clarity of illustration.
Figure 4:
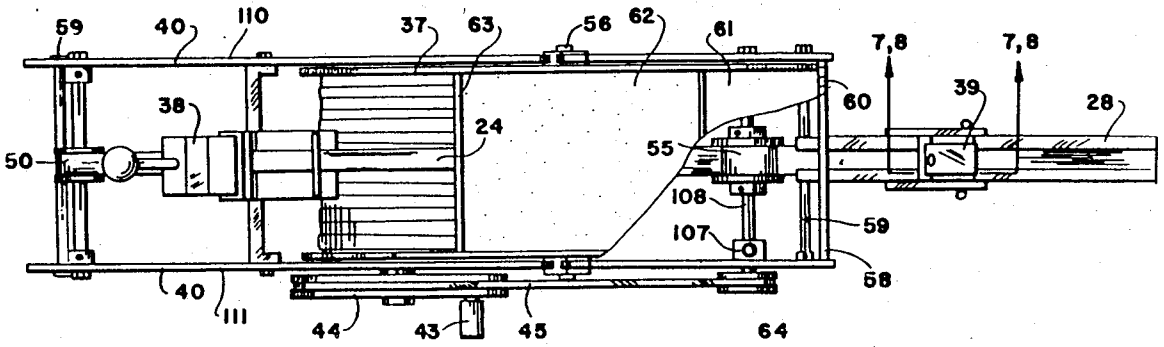
FIG. 4 is a top plan view of the apparatus of FIG. 2.
Figure 3:
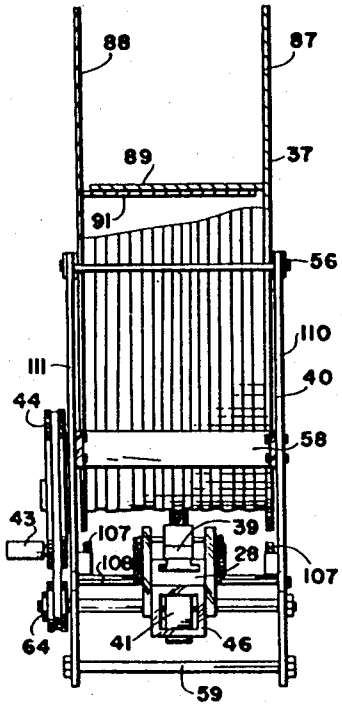
FIG. 3 is a front elevational view of the apparatus of FIG. 2.

In FIGS. 2, 3, and 4 there are shown some of the details of the apparatus in accord with this invention. Drum 37 holds a coiled supply of a continuous, rolled up length of tape 24 supported on removable and refillable drum 37. Drum 37 is more clearly shown in FIGS. 9 and 10 and includes two telescoping sections 17 and 18, section 18 including flange 87 connected to outer cylindrical body 89 and section 17 including flange 88 connected to inner smaller cylindrical body 91. When sections 17 and 18 are telescoped together, as shown in FIG. 9, a flanged drum is formed having a cylindrical body upon which the coil of tape 24 is supported. Tape 24 is a stiff paper tape, hereinafter more fully described, and the inner end 93 of the coil of tape is preferably doubled back onto itself and attached by any suitable means. The cylindrical bodies 89 and 91 include respective transverse slots 90 and 92 through which the portion of the tape adjacent the doubled back end portion 93 may slide edgewise into slot 90 of outer cylindrical body 89 and the inner cylindrical body 91 may be slipped within cylindrical body 89 and slot 92 will slide on either side of doubled back end portion 93, slots 90 and 92 being aligned when cylindrical bodies 89 and 91 are telescoped together. This completes the assembly of drum 37 and permits the unwinding of tape 24 from the outer free end of the tape coil.

Referring again to FIGS. 2–4, housing 40 comprises two parallel plates 110 and 111 forming walls separated by spacer bolts 59 and held in place by spacer bar 58. Drum 37 is mounted in housing 40 to be rotatable about shaft 56 through drum 37 by means of journals 57. Each journal 57 is a rectangular block having a central hole 109 to receive shaft 56 and having two of its opposite sides fashioned with elongated slots 95 that are substantially the same thickness as the plate walls 110 and 111 of housing 40. An appropriate notch 94 is cut at an angle into the plate walls 110 and 111 of housing 40, and these notches 94 are of a size to mate with slots 95 so as to receive slidable journals 57 thereinto. It will be appreciated that this arrangement permits a rapid removal of drum 37 when it is necessary to fill it with another roll of tape 24. In order to provide some protection against dirt and moisture, and also to provide a resistance to the free rotation of drum 37, a weighted cover 60–63 is provided to fit over the roll of tape 24 supported on drum 37. This cover 60–63 includes a rigid metal plate 61 attached to housing 40 by a hinge 60 and a fabric, e.g., felt, canvas or the like, attached to metal plate 61 with the opposite end of fabric 62 having attached thereto a small weight 63 to maintain fabric portion 62 in place draped over the top of the roll of tape 24 in drum 37. The fabric portion 62 will provide sufficient frictional resistance to prevent drum 37 from spinning too easily and thereby unwinding more of tape 24 from drum 37 than is needed at any one time.

Tape 24 leaving drum 37 is directed through an inverted U-bolt initial guide 103 attached to the support 104 to cause tape 24 to become centered in the main guideway 75 located before the cutting means 38. It will be appreciated that as tape 24 unwinds from drum 37 it will come from different directions off drum 37 as it approaches guide 103 which initially guides the tape toward the main guideway 75 to cause an accurate cut therethrough. Tape 24 passes through cutting means 38 which is manually operated to cut through the tape at this location when desired as hereinafter more fully described. Tape 24 passes beyond cutting means 38 around idler roll 50 and thence is directed over drive roll 41 into the end of guideway 28. Idler roll 55 and idler roll 50 are both flanged rolls to accommodate the tape thickness and to guide same. Idler roll 55 is biased downwardly and toward drive roll 41 and presses tape 24 against drive roll 41 and rotation of roll 41 causes the advancement of tape 24 beyond drive roll 41 into and through guideway 28. The pressure of roll 55 against drive roll 41 is adjustable by spring means 107 in the form of springs adjustably compressed by screws against shaft 108 movable in slots 113 in each of walls 110 and 111. These adjustable spring means 107 are shown to be located at each end of shaft 108 attached to housing 40.

Any type of drive means to rotate drive roll 41 is operable although it is preferred to employ a simple manual means such as that shown wherein a driving pulley 44 and handle 43 drive belt 45 which in turn drives pulley 64 attached to shaft 108 for rotating drive roll 41, and the rotation of pulley 44 provides the necessary driving force to move tape 24 to the proper position within guideway 28. Tape 24 after it passes drive roll 41 passes through brake means 39 and thence into the long stretch of guideway 28 that extends laterally across and underneath paper web 20 (as shown in FIG. 1). Brake means 39 applies a frictional resistance to the sliding of tape 24 through guideway 28 and this frictional resistance is to provide the tension on tape 24 needed to cause it to cut through paper web 20. Because the width of paper web 20 is a substantial distance, it is preferred to support guideway 28 on a relatively rigid structure 46 so that guideway 28 will not sag or vibrate to such an extent that it might impair the movement of tape 24 therethrough and/or out the open slot 101. Support 46 may be any reasonably rigid nonsagging structure such as an I-beam, an H-beam, a rectangular tube, or other structure well known in the art. Since the tape 24 must be pulled out of guideway slot 101 as it cuts the paper web, this frictional resistance may, in some instance, be sufficient without resort to a separate brake means 39 as shown and described hereinafter.

Figure 5:
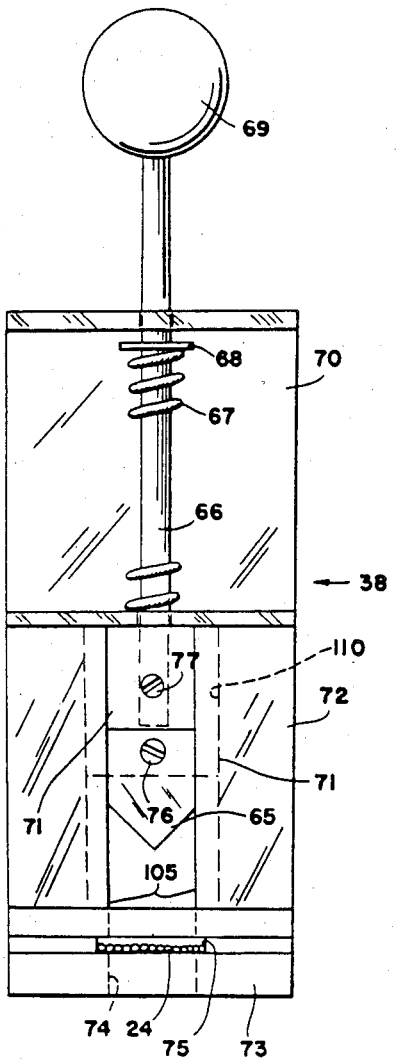
FIG. 5 is a front elevational view of the tape cutting means of this invention.
Figure 6:
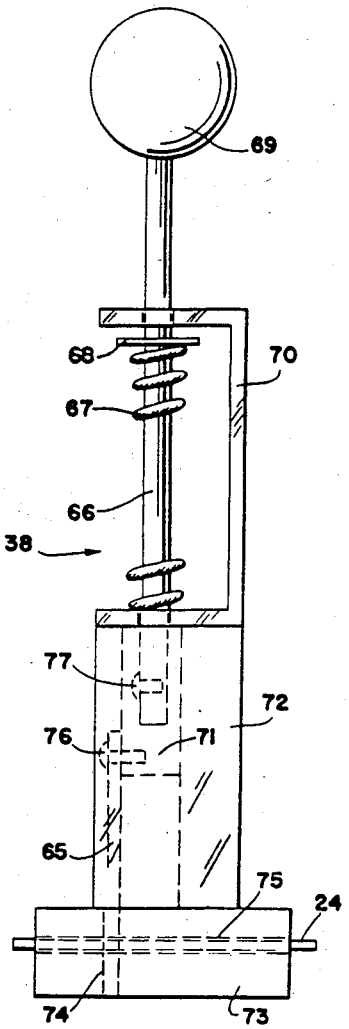
FIG. 6 is a side elevational view of the tape cutting means of FIG. 5.

In FIGS. 5 and 6 the cutting means 38 in accord with this invention is more clearly illustrated. For a full understanding thereof a description of the structure of the stiff tape 24 used in this invention is necessary. Tape 24, as shown in FIGS. 5, 11, 12, 13, and 14, is manufactured entirely of repulpable paper fiber which is twisted into separate strands and a plurality of the strands are laid together side-by-side in a lengthwise parallel abutting relationship and adhered to each other by a water-soluble adhesive to produce the tape. Preferably the tape is one strand thick and several strands wide. The tape, for example, may be 0.5–1.0 inch wide and 0.02–0.05 inch in thickness which results in a tape of 10–20 strands, each about 0.02–0.05 inch in diameter. When tape 24 is cut in accord with the method and use of cutting means 38 of this invention, it is preferred not to cut completely through the tape, but only to partially sever the tape. While such partial severing can be accomplished in perhaps several different ways, it is preferred to sever the tape by cutting completely through all of the strands by a lateral cut, except for the edges of the tape which generally are the two outside strands of the tape by the cutting means 38 illustrated in FIGS. 5 and 6.

Cutting means 38 includes a guillotine knife blade 65 which is generally wide enough to cut through tape 24 except for the two outer strands. Knife blade 65 operates by moving reciprocally up and down in a groove 105 in guide housing 72 having an internal channel 110 through which sliding block 71 reciprocates. Knife blade 65 is affixed to block 71 by means of screw 76 so that blade 65 moves up and down as block 71 moves up and down. Guide housing 72 rests on base 73 through which knife blade guide 74 passes at right angles to feed slot 75 which guides tape 24 through base 73. Channel 110 has a reasonably close fit with block 71 so as to accurately guide the knife blade 65 to cut through tape 24 with good accuracy which is enhanced by knife blade guide 74. Shaft 66 is attached to block 71 by means of screw 77 and provides the implementing means by which knife blade 65 is manually moved to cut tape 24. Shaft 66 extends upwardly and terminates in handle 69 which is in any convenient shape for manually pushing knife blade 65 through tape 24. Shaft 66 is mounted in shaft guide 70 and it is biased upwardly by compression spring 67 operating toward the lower shoulder of guide 70 and engaging against washer 68 which is affixed to shaft 66. Accordingly, as shaft 66 is pressed downwardly to its cutting operable position, spring 67 is compressed, and when the force on handle 69 is released, spring 67 pushes shaft 66 upwardly to its upward position shown in FIGS. 5 and 6.

Figure 11:
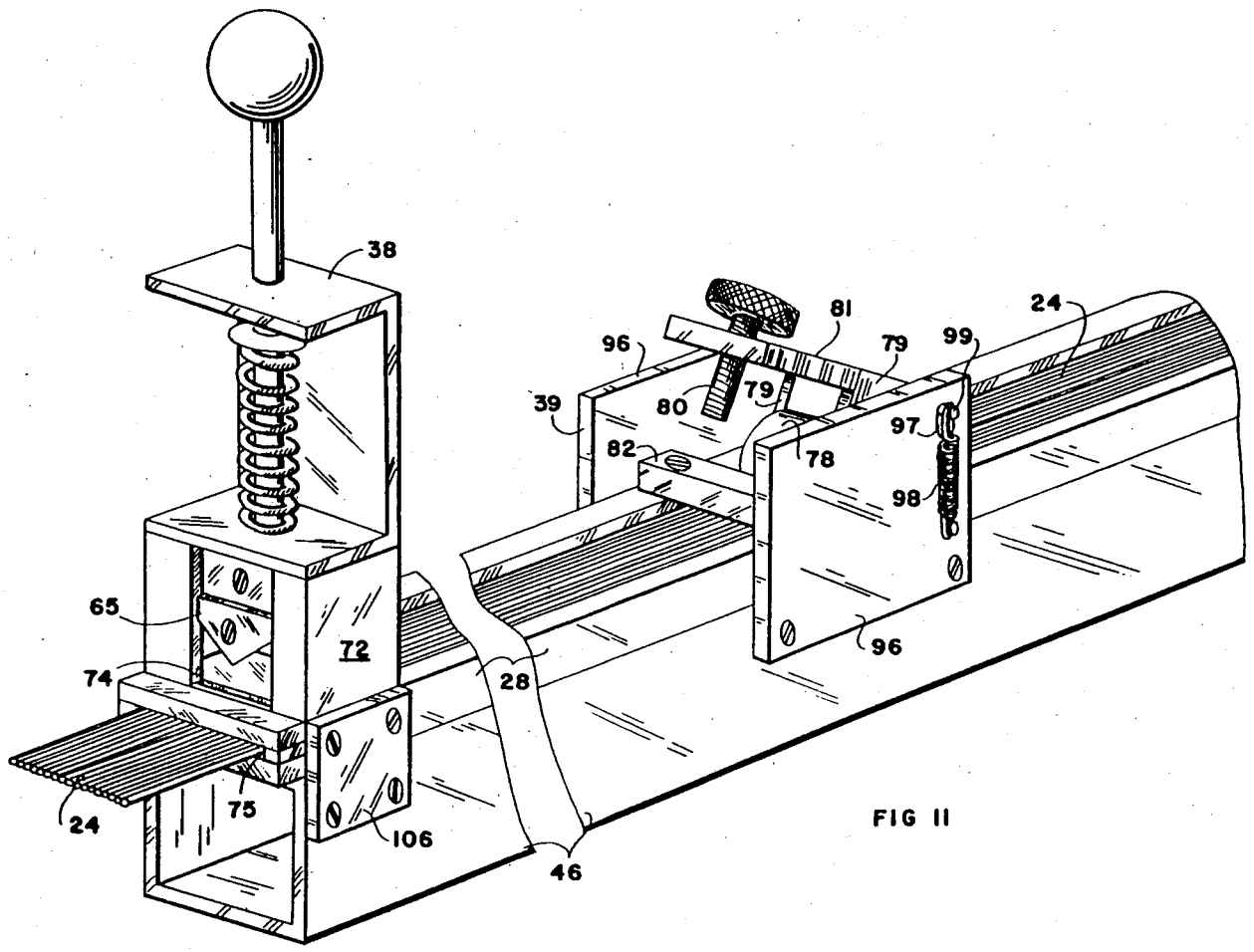
FIG. 11 is an isometric view of another embodiment of the apparatus in accord with this invention.

In FIGS. 7, 8, and 11 the constructional details of brake means 39 are more clearly shown for providing a frictional resistance to the movement of tape 24 to restrain it from sliding too freely through guideway 28 and to cause the partially severed tape to become fully separated as the cut tape passes brake means 39. The brake means 39 includes a supporting structure 46 underneath guideway 28 which carries tape 24. A pressure member 78 is pivoted about pin 99 so as to provide more or less pressure upon tape 24 as it passes over a supporting solid surface, which may be a roller 84, as shown in FIG. 7, or a solid flat surface or wear pad 112 of guideway 28, as shown in FIG. 8. Pin 99 is attached to leg 79 on each end of pressure member 78. Pressure member 78 preferably is a nonrotatable fixed surface, but it may be a roller. Pressure member 78 is fixed to legs 79 which in turn are fixed to adjustment screw holder 81 through which adjustment screw 80 is threadedly engaged. As the movable components of brake means 39 are rotated about pin 99, it may take any position from that shown in solid lines to that shown in broken lines 86 in FIG. 8. Side walls 96 are attached to guideway 28 or to its support 46 and serve as a support for brake means 39. Pin 99 is attached to walls 96 by means of tension springs 98 which are attached at their lower ends to walls 96. Slot 97 is provided in walls 96 to accommodate the movement of pin 99 as the structure is rotated about pin 99 in its various positions during the operation illustrated in FIG. 7. When this structure is rotated to the broken line position 86, as shown in FIG. 8, no frictional resistance is applied to tape 24 and it is easily threaded through guideway 28 from one end to the other. After tape 24 has been threaded through the length of guideway 28 and is ready to be attached to the empty spool 23, the movable portion of brake means 39 is rotated back to the position shown in solid lines in FIG. 8 to cause tape 24 to be impeded in its movement in the direction of arrow 114. Adjustment screw 80 acts against stop 82 and by adjustment of screw 80 more or less frictional resistance can be applied to tape 24, when it is in the position shown in FIG. 8. Tension springs 98 apply the necessary force to pull the movable portion of brake means 39 down against tape 24 through guideway 28. It is desirable to employ a stop pin 83 to prevent the brake structure from tilting any farther backward than that shown in dotted lines 86 so as not to interfere with the threading of tape 24 through guideway 28. With tape 24 threaded completely through the length of guideway 28 and in place for attachment to empty spool 23 as shown in FIG. 1, the movable portion of brake means 39 is rotated to the position shown in solid lines in FIG. 8 and the tape is partially severed by cutting means 38 prior to the free end 51 of tape 24 being attached to spool 23. The frictional resistance applied by brake means 39 is sufficient, when tape 24 is attached to spool 23, to strip tape 24 out of upper open slot 101 in guideway 28 from its far end 50 back toward its near end 49 as the rotation of empty spool 23 causes tape 24 to spiral across and about the spool 23 from far end 50 to near end 49. The tension provided by brake means 39 causes tape 24 to be sufficiently taut and thus to provide a cutting edge for cutting through paper web 20. The partial severing of tape 24 by cutting means 38 permits the pulling of tape 24 behind the cut portion through the idler rolls 50 and 55 in housing 40 toward brake means 39 without rupture of the uncut strands of tape 24 until that cut portion passes completely through brake means 39. The tension on tape 24 is then sufficient to rupture the final uncut edge strands of tape 24 and thus sever the tape to await its next use when an empty spool again must be fed with a cut portion of paper web 20 by another length of tape 24.

Figure 12:
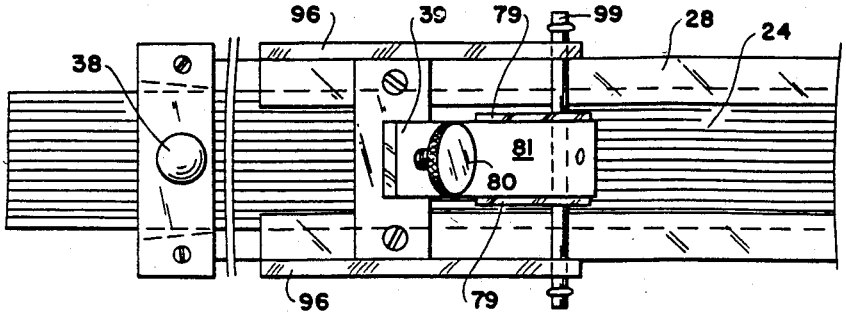
FIG. 12 is a top plan view of the apparatus of FIG. 11.

In FIGS. 11 and 12 there is shown another simplified embodiment of this invention wherein brake means 39, as described previously in connection with FIGS. 7 or 8, is attached adjacent the end of guideway 28 supported on structure 46 and receiving a tape 24 that passes through cutting means 38 to be cut, as described previously in connection with FIGS. 5 and 6. Primarily this embodiment eliminates any particular structure for dispensing a supply of tape 24 on drum 37 and the driving means to push tape 24 through the channel in guideway 28. Tape 24 is reasonably stiff and can readily be pushed through guideway 28 by hand, if desired, and permits any type of supply of tape 24 to be pushed through cutting means 38 and brake means 39 and across the lateral width of travelling web of paper 20. The free end of tape 24 at the far end of guideway 28 can then be removed by hand, be coated with an adhesive, and be ready to be applied by hand to the edge of empty spool 23. Tape 24 is then cut by cutting means 38 for a sufficient distance longer than that required to stretch across web 20 to provide the necessary length for spiralling around spool 23 and to cut completely across web 20. Normally, this extra length is about 3–4 feet longer than the length of spool 23.

Figure 13:
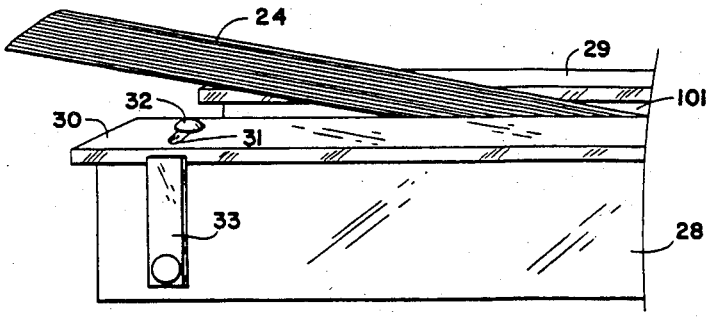
FIG. 13 is an isometric view of another embodiment of the guideway portion of this invention.
Figure 14:
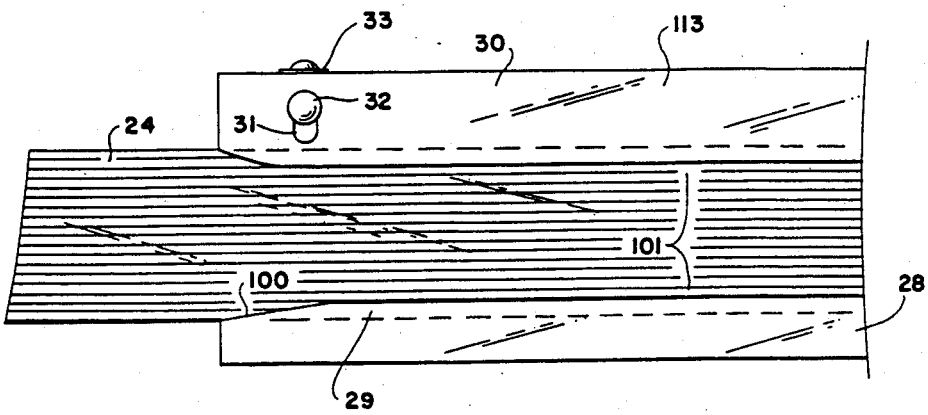
FIG. 14 is a top plan view of the guideway of FIG. 13.

In FIGS. 13 and 14 there is shown another embodiment of guideway 28 in which one of the shoulders of guideway 28 is movable to provide easier stripping of tape 24 from the channel in guideway 28. In either embodiment of guideway 28 it should be made entirely of a resilient plastic material, such as polyethylene. The guideway is made with an internal lengthwise slot which is slightly wider than the width of tape 24 and with a solid lower surface to the guide channel. An open slot 101 along the upper surface of the channel provides two inwardly directed shoulders for preventing tape 24 from easily jumping out of the channel and yet slot 101 is sufficiently wide to permit tape 24 to become bent along its strand longitudinal axis and to be stripped out of the channel by force when it is applied to empty spool 23. Particularly if guideway 28 is made of aluminum or other rigid material, the embodiment in FIGS. 13 and 14 may be necessary. Guideway 28 of FIGS. 13 and 14 has two inwardly directed shoulders 29 and 30, the former being a fixed shoulder and the latter being a movable shoulder. The open portion between shoulders 29 and 30 is slot 101. Shoulder 30 is formed by a plate 113 which has a plurality of slots 31 in it at spaced intervals with pins 32 attached to the main body of guideway 28 cooperating with slots 31 to permit shoulder 30 to move laterally the distance of the length of slot 31. In order to maintain the shoulder 30 in its proper positioning until tape 24 is stripped therefrom, there are added leaf springs 33 in spaced intervals to maintain shoulder 30 in its most inward position until tape 24 is pulled out from the channel as shown in FIG. 13. A taper is provided at each of the inlet and outlet ends of guideway 28 along shoulders 29 and 30, as shown at 100, to provide an easy entrance for feeding tape 24 therein and to facilitate the stripping of tape 24 from the channel of guideway 28.

The improved method in accord with this invention includes the feeding of the free end of a stiff paper tape 24 into one end 49 of an elongated guideway 28 placed beneath and laterally across the travelling web of paper 20 and extending substantially the width of the empty spool 23 to which the travelling web 20 is to be attached. The free end 51 of the tape 24 is extended or removed from the far end 50 of the guideway 28 and adhered to the edge of the empty spool 23, and frictional resistance is applied to the removal of the tape 24 from the guideway 28. The adhesion of the tape 24 to the spool 28 combined with the frictional resistance causes the tape 24 to spiral around the empty spool 23 as the spool rotates, and the spiralling causes the tape 24 to travel across the face of the empty spool cutting through the travelling web of paper as it does so and transfers the web onto spool 23. If the tape is in a continuous length if will have been partially severed before the frictional resistance is applied to the tape and before adhering the free end 51 to spool 23. As the tape 24 spirals across the length of the empty spool 23, it is under sufficient tension to strip it from the guideway 28 through open slot 101, cut the web of paper 20, and guide that cut edge to become transferred to the empty spool to start the wrapping of the web thereonto. The partially cut tape is automatically severed completely when that cut portion passes through the frictional res:stance and is subjected to the full force of the tension of the tape 24. It is particularly important in the preferred method of this invention to support the stiff repulpable paper tape in a guideway 28 completely across the width of the paper web and to partially cut through the tape before applying a frictional resistance to the passage of the tape as it is pulled through the guideway by the tape spiralling onto the empty spool 23, and then automatically completely rupturing tape 24 when the partial cut portion passes through the frictional resistance location.

It is to be understood that the dispenser 16 may be converted into a power assisted or operated one without departing from the scope or spirit of the invention. For example, an electric motor could be employed for the hand crank 43 and a solenoid or pneumatic cylinder and piston may be used to power the cutting means 38. In this manner a person could control the apparatus remotely even from the side of travelling web 20 opposite to the location of the dispensing apparatus 16.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what is desired by Letters Patent is:

1. In an apparatus for cutting with a tape a travelling web of paper being wound on a first spool and transferring that travelling web onto an empty spool by attaching said tape to said empty spool, the system characterized by:

(1) means for supplying a length of repulpable paper fiber stiff tape;

(2) an elongated guideway with an elongated open slot facing upwardly beneath said travelling web and having opposite open ends adjacent the side edges of said travelling web, said guideway receiving said tape delivered slidingly into one said open end and exiting out of the other said open end; and (3) a brake means frictionally engaging said tape.

2. The apparatus of claim 1 which additionally includes a cutting means for laterally partially severing said tape between the side edges of said tape, said partially severed tape being automatically completely severed after passage thereof past said brake means when pulled by said tape wrapping about the empty spool.

3. The apparatus of claim 2 further including a housing, said means for supplying includes a drum rotatably mounted on said housing and a supply of tape rolled on said drum, said cutting means mounted onto said housing, and a drive means connected to said housing and engaging said tape for feeding said tape through said guideway.

4. The apparatus of claim 2 wherein said tape is characterized by a plurality of lengthwise parallel abutting twisted strands of repulpable paper fiber, said strands being adhered to each other by a water-soluble adhesive.

5. The apparatus of claim 4 wherein said tape consists of a single layer of said parallel strands.

6. The apparatus of claim 2 wherein said brake means is characterized by an adjustable pressure surface on the top of said tape and a support means below said tape.

7. The apparatus of claim 6 wherein said support means is a roller.

8. The apparatus of claim 6 wherein said support means is a solid, immobile surface.

9. The apparatus of claim 2 wherein said guideway includes an elongated member having a passageway extending between said open ends and communicating with said open slot throughout its length, said passageway having a width slightly wider than the width of said tape, said member having at least one inwardly directed shoulder to guide said tape through said passageway.

10. The apparatus of claim 9 wherein said guideway has two inwardly directed shoulders, one of which being laterally movable outwardly and spring biased inwardly.

11. The apparatus of claim 9 wherein said guideway extends at its exiting end to a position closely adjacent to the edge of the empty spool where said tape is attached.

12. The apparatus of claim 2 wherein said drive means includes at least one drive roller over which said tape passes after being pulled from said supply roll and before passing through said brake means, said drive means including a shaft rotatably mounted to said housing and a hand crank means mounted to said shaft for rotating same.

13. The apparatus of claim 4 wherein said cutting means includes a centering guide slot for the passage of said tape therein and through which said cutting means passes to partially cut said tape prior to feeding through said brake means.

14. The apparatus of claim 13 wherein said cutting means is a manually operable guillotine knife which substantially severs said strands between the two outer strands of said tape.

15. An apparatus for cutting a travelling web of paper being wound into a spool and transferring the cut web to an empty spool for winding, said cutting and transferring being accomplished by attaching a tape to the edge of said empty spool, the apparatus being characterized by:

(1) a continuous length of cutting tape wound on a rotatable drum, said tape being thin and stiff and comprising a plurality of lengthwise parallel strands of twisted repulpable paper fibers positioned side-by-side and bonded to each other by a water-soluble adhesive, said tape being one strand in thickness;

(2) an elongated guideway slightly wider than the width of said tape, said guideway having an elongated slot on its upper side and closed on its lower side and having an inwardly directed shoulder, on said upper side along each lateral side of the guideway; said guideway being parallel to and extending substantially the entire length of said empty spool and being positioned below said travelling web of paper;

(3) a brake means being located between said guideway and said drum, said brake means comprising an underneath supporting surface and an upper pressure surface adjustable to provide selective frictional resistance to the passage of said tape therebetween; and (4) cutting means for cutting laterally across said tape to partially sever said strands, said cutting means being located between said brake means and said drum of tape.

16. The apparatus of claim 15 further including a housing on which is mounted said drum of tape, said cutting means, said brake means, and a driving roller adapted to pull tape from said drum through said cutting means and push said tape through said brake means and thence through said guideway.

17. The apparatus of claim 16 wherein said driving roller is driven by a manually rotatable crank.

18. The apparatus of claim 15 wherein said cutting means includes a manually operable guillotine knife blade laterally disposed from said tape, a backing support having a tape guide slot for centering said tape for cutting by said blade.

19. The apparatus of claim 15 wherein said brake means includes a freely rotatable fixed position roller underneath said tape and a surface above said tape which is adjustable to press against said tape with a selected pressure.

20. The apparatus of claim 15 wherein said rotatable drum is characterized by two telescoping cylindrical members each having a lateral flange attached to one end of a tubular cylindrical body, said cylindrical bodies telescoping together to produce an assembly of a cylindrical body with two lateral end flanges.

21. The apparatus of claim 15 which additionally includes two flanged rollers to receive tape from said drum and lead it to said guideway.

22. The apparatus of claim 16 wherein said drum has a central shaft means around which said drum is rotatable, said shaft means being mounted in journals having two parallel slots on opposite sides of said shaft means, said slots sliding into mating notches in said housing.

23. The apparatus of claim 15 wherein said guideway rests upon a substantially rigid support.

24. An improved method for cutting a travelling web of paper being wound on a spool and transferring the web after cutting to an empty spool, the method including a cutting tape attachable to said empty spool, the tape automatically travelling spirally across said empty spool cutting the web of paper, and winding the cut portion onto the empty spool; wherein the improvement comprises the steps of:

(1) feeding the free end of a stiff paper tape from the near end to the far end of an elongated guideway positioned beneath and extending substantially the width of said travelling web;
(2) extending the free end of said tape from the far end of said guideway;
(3) adhering said free end to said empty spool adjacent the far end thereof; and
(4) applying frictional resistance to the removal of said tape from said guideway.

25. The method of claim 24 further comprising the step of:

(5) partially cutting laterally through said tape adjacent said near end of said guideway spacedly ahead of the location at which frictional resistance is applied to said tape.

26. The method of claim 24 wherein the uncut portion of said partially cut tape is rupturable automatically by the tension produced on said tape during its winding about said empty spool and cutting and transferring of said web of paper to said empty spool.

27. This method of claim 24 wherein said frictional resistance is applied to squeezing said tape between two surfaces prior to its entry into said guideway.

28. The method of claim 24 further comprising the steps of:

(5) dispensing said tape from a continuous roll of tape prior to step (1);
(6) partially cutting laterally through said tape adjacent said near end of said guideway spacedly ahead of the location at which frictional resistance is applied to said tape; and
(7) applying an adhesive to the upper face of the free end of said tape prior to adhering said free end to said empty spool.

29. The method of claim 28 wherein step (7) is performed prior to step (1).

30. The method of claim 28 wherein step (7) is performed prior to step (2).

31. The method of claim 30 in which step (2) is performed after step (5) and step (2) is performed by further feeding said tape from the near end through said guideway to acontacting position where said free end of said tape is automatically attached by step (3) to said empty spool.

32. The method of claim 24 further comprising the step of (5) applying an adhesive to the upper face of the free end of said tape.

33. The method of claim 24 further comprising the step of (5) guiding said tape to a position closely adjacent said empty roll by said guideway supporting said tape and having an open upper slot throughout the length of said guideway whereby said tape is stripped out of said guideway through said open slot.

34. The method of claim 24 further comprising the steps of:

(5) partially cutting laterally through said tape adjacent said near end of said guideway spacedly ahead of the location at which frictional resistance is applied to said tape;
(6) applying an adhesive to the upper face of the free end of said tape prior to adhering said free end in step (3); and
(7) pulling said partially cut tape beyond the frictional resistance to automatically rupture same.

35. A method for cutting a travelling web of paper being wound on a spool and transferring the web after cutting to an empty spool, the method including attaching one end of a cutting tape to the edge of the empty spool while applying tension to the other end of the tape stretched below the web and across the width of the web, the tape automatically travelling spirally across the empty spool, cutting and transferring the cut portion of the web to the empty spool, to be wound thereon, the method being characterized by the steps of:

(1) applying an adhesive to the upper side adjacent the free end of a stiff paper tape;
(2) feeding the free end through an elongated guideway extending at least from the near end to the far end of the empty spool and positioned below said travelling web, the guideway having an upwardly facing open slot over the entire length of the guideway to permit stripping of the tape there- through;
(3) cutting partially through the tape laterally of its midsection adjacent the near end;
(4) extending the free end of the tape from the far end of the guideway;
(5) feeding the free end of the tape to the empty spool with said adhesive positioned to contact the empty spool;
(6) applying tension to the tape in the guideway causing rupture of the uncut portion of the partially cut tape; and
(7) automatically stripping the tape from the open side of the guideway as the web is cut and the cut web is transferred to the empty spool.

36. The method of claim 35 wherein step (6) includes the step of (8) providing a frictional sliding resistance to the tape between the near end of the guideway and the partially cut end of the tape.

37. The method of claim 36 further comprising the step of (8) providing an excess length of said tape sufficiently longer than the length of the empty spool to permit the frictional sliding resistance to provide the tension for a time sufficient to permit the tape at the far end to be adhered to the empty spool and become spirally wrapped about the spool.

38. The method of claim 35 wherein step (3) includes the step of (8) cutting the tape formed from a plurality of parallel lengthwise abutting strands of twisted repulpable paper fiber and one strand thick adhered to each other by a watersoluble adhesive to produce a tape one strand thick, said cutting step (8) severing substantially all internal strands and not severing generally the two outside strands running along the side edges of the tape.

39. The method of claim 35 further comprising the step of (8) locating the far end of the guideway to a position closely adjacent the nip between the-rotating drive roll and the empty spool to permit the feeding step (2) of the tape automatically from the far end into the nip.

40. The method of claim 35 further comprising the step (8) dispensing the tape from a roll of tape mounted on a rotating drum supporting the roll of tape.

* * * * *